United States Patent [19]

Wright, Jr.

[11] 4,243,501

[45] Jan. 6, 1981

[54] PROCESS AND APPARATUS FOR THE REGENERATION OF CHROMIC ACID BATHS

[75] Inventor: Leslie S. Wright, Jr., Greenfield, Ind.

[73] Assignee: Michael Ladney, Jr., Grosse Pointe Shores, Mich.

[21] Appl. No.: 25,381

[22] Filed: Mar. 30, 1979

[51] Int. Cl.[3] ..... B01D 13/02; C02C 5/12

[52] U.S. Cl. ..... 204/180 P; 204/89; 204/130; 204/151; 204/DIG. 13

[58] Field of Search ..... 204/97, 130, 180 P, 204/151, 89, DIG. 13

[56] References Cited

U.S. PATENT DOCUMENTS

| | | | |
|---|---|---|---|
| 3,481,851 | 12/1969 | Lancy | 204/180 P |
| 3,761,369 | 9/1973 | Tirrell | 204/180 P X |
| 3,764,503 | 10/1973 | Lancy et al. | 204/180 P |
| 3,909,381 | 9/1975 | Ehrsar | 204/180 P |
| 3,948,738 | 4/1976 | Fujii | 204/180 P X |
| 4,118,295 | 10/1978 | Korenowski et al. | 204/180 P X |

*Primary Examiner*—Arthur C. Prescott

*Attorney, Agent, or Firm*—Barnes, Kisselle, Raisch & Choate

[57] ABSTRACT

A process and electrodialysis cell for regenerating used chromic acid baths for reuse. The process and apparatus have an anolyte chamber and a catholyte chamber separated by a cation permeable membrane and utilize as an improved catholyte solution an aqueous mixture of a water soluble salt such as sodium sulfate. A preferred anode which is not decomposed by the chromic acid bath comprises by weight about 1.5% of silver, about 5% of antimony, about 3% of tin and the balance lead.

12 Claims, 2 Drawing Figures

PROCESS AND APPARATUS FOR THE REGENERATION OF CHROMIC ACID BATHS

Figure 1:
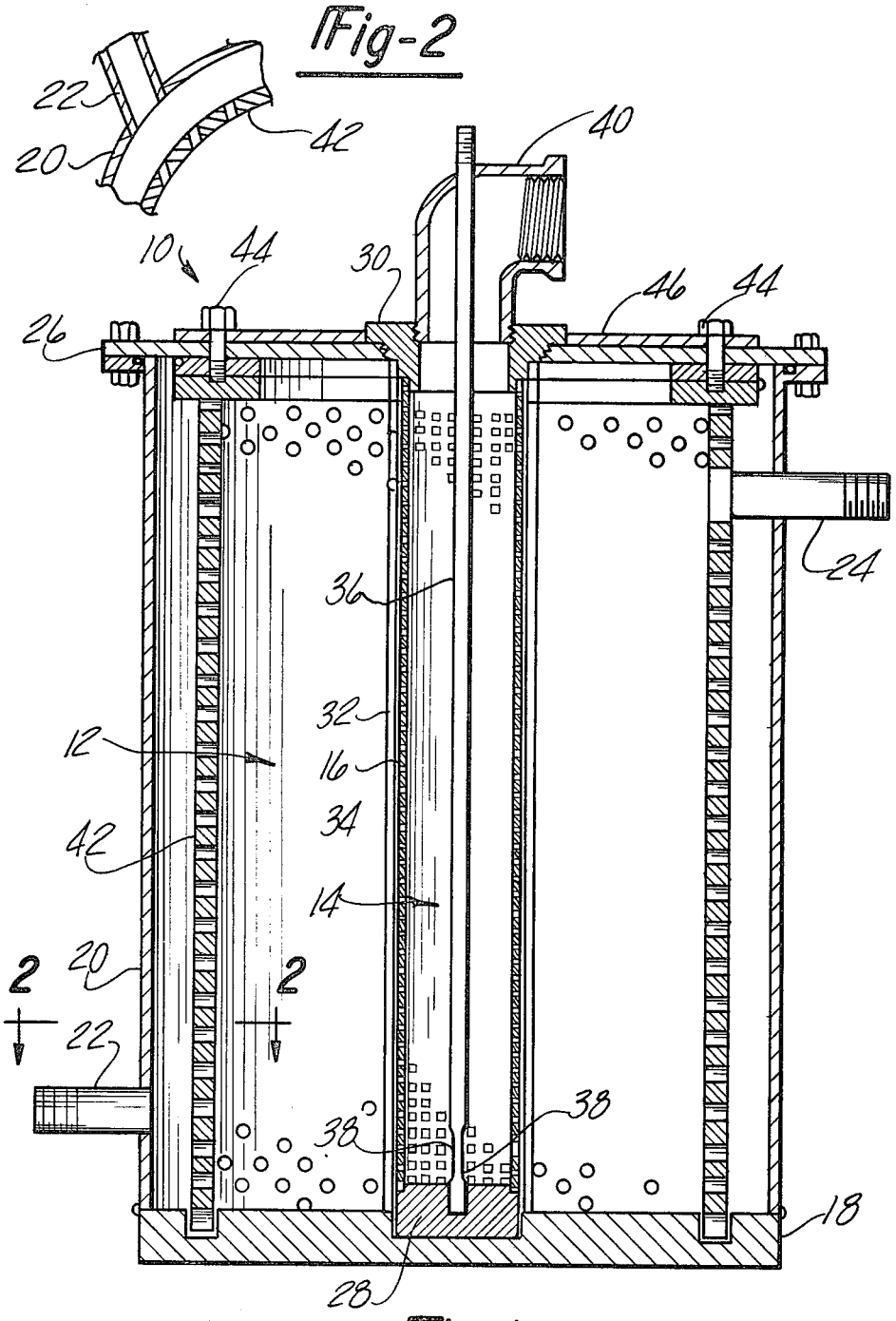

This invention relates to the treatment of chromic acid solutions and more particularly to the regeneration for reuse of chromic acid baths which have been used in electroplating of chromium, pickling of other metals, etching of plastic, anodyzing of aluminum, and the like.

Chromic acid solutions or baths containing hexavalent chromium have been previously used in the electroplating of chrome, the anodyzing of aluminum, and the etching on the surface of various plastics such as polypropylene, polyethylene, and ABS plastics. When such baths containing hexavalent chromium are used over a period of time for such purposes they become unsatisfactory for further use and must be either disposed of or regenerated. Such baths are believed to become unsatisfactory for further use due to some of the hexavalent chromium becoming reduced to trivalent chromium and the bath picking up various tramp or foreign ions of metals such as copper, zinc, nickel, and iron. Various processes and apparatus utilizing electrodialysis cells for regenerating used chromic acid baths have been previously developed, two of which are disclosed in U.S. Pat. Nos. 3,481,851 and 4,006,067.

U.S. Pat. No. 3,481,851 discloses an electrodialysis cell with an anolyte chamber having an anode therein and containing used chromic acid solution separated by a cation permeable membrane from a catholyte chamber having a cathode therein and containing an acidic catholyte solution such as hydrochloric acid solution. When a suitable electric current is applied to the anode and the cathode, trivalent chromium in the used chromium solution is reoxidized at the anode to hexavalent chromium and ions of tramp or foreign metals migrate through the membrane and into the acidic catholyte solution thereby regenerating the chromic acid solution for further use. Similarly, U.S. Pat. No. 4,006,067 discloses an electrochemical cell for regenerating used chromic acid solutions in which ordinary tap water is used as the catholyte solution.

Objects of this invention are to provide a process and an electrodialysis apparatus for regenerating used chromic acid baths which utilize an inexpensive catholyte solution and an anode which does not deteriorate in the presence of the used chromic acid bath and hence is particularly economical, durable and dependable, and has a relatively long in-service life compared to previously known processes and apparatus.

These and other objects, features and advantages of this invention will be apparent from the following detailed description, appended claims, and accompanying drawing in which:

FIG. 1 is a sectional view of an electrodialysis cell constructed in accordance with the apparatus of this invention and which can be used in carrying out the process of this invention; and FIG. 2 is a fragmentary sectional view of line 2—2 of FIG. 1.

In accordance with one feature of both the process and apparatus of this invention an aqueous solution of a mildly acidic water soluble inorganic salt is used as the catholyte solution. Suitable salts for such an aqueous catholyte solution are sodium sulfate, sodium bisulfate, sodium carbonate and calcium sulfate. Such an aqueous mildly acidic solution may have a concentration of about 8 oz. to 32 oz. of salt per gallon of mixture and preferably in the range of about 14 to 18 oz. per gallon.

When using such solutions of salt as the catholyte it is believed the cathode should be operated at a potential in the range of about 12 to 25 volts, desirably 14 to 20 volts, and preferably 15 to 18 volts and with a current density in the range of 20 to 300, desirably at least 100 and preferably about 150 to 200 amperes per square foot of anode area. It is believed that operating the cathode at substantially greater voltage and/or current density may under at least some circumstances result in excess heating of the cell and the solutions contained therein and decrease the efficiency of the process and apparatus for regenerating used chromic acid solution.

As shown in FIG. 1 a suitable electrodialysis cell 10 has an annular anolyte chamber 12 and a cylindrical catholyte chamber 14 separated by an annular cation permeable membrane 16. Cell 10 has a bottom wall 18, a cylindrical side wall 20 with an anode chamber inlet conduit 22 and an outlet conduit 24 fixed therein, and a cover 26 secured to the top thereof by suitable fasteners.

Catholyte chamber 14 is defined by the cooperation of tubular membrane 16 with a lower end plug 28 and an upper mounting ring 30. Since membrane 16 is rather fragile, it is received between perforate outer and inner tubes 32 and 34 secured adjacent their ends to plug 28 and ring 30 to limit the extent to which the membrane can be displaced from its normal position by differential pressures and surges in the flow of solutions through apparatus 10. To prevent deterioration and corrosion perforate tubes 32 and 34 are made of chemically inert plastic material. Catholyte solution is injected into the lower end of chamber 14 through a hollow tubular cathode 36 having openings 38 in its sidewall adjacent the lower end thereof and is discharged from the upper end of the chamber through ring 30 and an outlet elbow 40 connected to the ring. Preferably perforated tubes 32 and 34, plug 28 and ring 30 are made from an inert material such as chlorinated polyvinyl chloride or Teflon.

A perforated cylindrical anode 42 is generally coaxially received in anolyte chamber 12 and secured to cover 26 by cap screws 44 extending through an annular plate 46 received on the upper face of cover 26. Preferably annular plate 46 and cap screws 44 are of a material such as copper in order to provide an electrically conductive path or conduit for anode 28.

In accordance with another feature of this invention a composition for anode 42 has been developed which is believed to be subject to little, if any, deterioration or dissolution by chromic acid solutions and, hence, provides a process and apparatus with increased service life. This anode composition comprises about 1 to 20% and preferably about 1.5% by weight of silver, about 3 to 8% and preferably about 5% by weight of antimony, about 2 to 6% and preferably about 3% by weight of tin, and with the principal constituent of the balance being lead. The silver content provides corrosion resistance preventing rapid deterioration in use of the anode and the antimony content increases the strength and rigidity of the anode. The tin content promotes formation of an oxide film on the surface of the anode which enhances the rate of oxidation of the trivalent chromium to hexavalent chromium.

It has been discovered in order to achieve a practical rate of oxidation of trivalent chromium the anolyte and catholyte solutions should be circulated around and in contact with the surfaces of the anode and cathode respectively at a substantial rate of flow. As shown in FIG. 2 the agitation and circulation of the anolyte solution around the anode is enhanced by inclining inlet circuit 22 to anode 42 so that the anolyte solution tends to swirl or move circumferentially around the anode. Similarly, circulation of the catholyte solution over the cathode is enhanced by discharging such solution into the bottom of catholyte chamber 14 and removing the solution adjacent the top of the chamber.

By way of example and not limitation, the process of this invention has been successfully utilized to regenerate used chromic acid solution in an electrodialysis cell 10 having an anode 12 composed by weight of about 1.5% silver, about 5% antimony, about 3% tin, and the balance lead. The cell was cylindrical with a height of about 48 inches and an inside diameter of about 17 inches. The anode 42 had an outside diameter of about 12 5/16 inches and a wall thickness of about 7/32 of an inch, the cathode 36 had an outside diameter of about 1 inch and a wall thickness of about 3/32 of an inch and the membrane 16 has a diameter of about 3 3/64 inches. The catholyte solution was a mixture of about one pound of sodium sulfate per gallon of water, having a pH value of 3 and being circulated through the catholyte chamber 14 at the rate of about 20 gallons per minute at a temperature of about 125° F. The used chromic acid solution was circulated through the anolyte chamber 12 at a rate of about 20 gallons per minute at a temperature of about 160° F. with a potential of about 18 volts and a current of 800 amps applied to the cell. The initial composition of the used chromic acid solution circulated through the cell was about 4 pounds per gallon of chromium trioxide, 3 oz. per gallon of trivalent chromium oxide, and 20% sulfuric acid by volume.

The flow rate in gallons per minute of the catholyte solution was about fifteen times the capacity in gallons of the catholyte chamber and the flow rate in gallons per minute of the chromic acid solution was about two fifths the capacity in gallons of the anolyte chamber. It is believed such flow rates in gallons per minute should be in the range of about 5 to 25 and 0.2 to 0.4 times the capacity in gallons of the catholyte and anolyte chambers respectively.

I claim:

1. In an electrochemical process of treating baths containing trivalent chromium, to convert such trivalent chromium to hexavalent chromium in which a bath containing trivalent chromium is circulated in the anode compartment of an electrodialysis cell, is in contact with an anode, and is separated from a cathode compartment having a cathode therein by a cation permeable membrane, the improvement comprising an aqueous catholyte mixture in contact with the cathode and consisting essentially of a mildly acidic and water soluble inorganic salt and electrically energizing the cell with a sufficient potential difference between the anode and the cathode such that any dissolved foreign metal ions in the used chromic bath will move through the membrane and into the catholyte mixture and trivalent chromium in the chromium bath is reoxidized into hexavalent chromium.

2. The improvement as defined in claim 1 wherein the catholyte consists essentially of an aqueous mixture of inorganic sodium or calcium salts selected from the group of sodium sulfate, sodium bisulfate, sodium carbonate and calcium sulfate.

3. The improvement as defined in claim 1 wherein the anode and the cathode are subjected to a potential difference of at least about 14 volts.

4. The improvement as defined in claim 3 wherein the cathode is subjected to a current density of at least 100 amps per square foot.

5. The improvement as defined in claim 1 wherein the difference in the electric potential applied to the anode and the cathode is in the range of 14 to 20 volts.

6. The improvement as defined in claim 1 wherein the composition of the anode consists essentially of at least 1% by weight of silver, at least 3% by weight of antimony, at least 2% by weight of tin and the balance is lead.

7. The improvement as defined in claim 1 wherein the composition of the anode consists essentially of about 1 to 20% by weight of silver, about 3 to 8% by weight of antimony, about 2 to 6% by weight of tin and the balance is lead.

8. The improvement as defined in claim 1 wherein the rate of flow in gallons per minute of chromic acid solution through the anode compartment is at least about two fifths the quantity of the chromic acid solution in gallons contained in the anode compartment.

9. The improvement as defined in claim 8 wherein the rate in gallons per minute at which the catholyte mixture is circulated through the cathode compartment is at least about fifteen times the quantity in gallons of the catholyte mixture in the cathode compartment.

10. The improvement as defined in claim 1 wherein the rate in gallons per minute at which the catholyte mixture is circulated through the cathode compartment is at least about fifteen times the quantity in gallons of the catholyte mixture in the cathode compartment.

11. The improvement as defined in claim 1 wherein the composition of said anode consists essentially of about 1.5% of silver, about 5% of antimony, about 3% of tin, and the balance is lead.

12. The improvement as defined in claim 1 wherein the catholyte consists essentially of an aqueous mixture of inorganic sodium or calcium salts.

* * * * *